US009151094B2

(12) United States Patent
Lambertini

(10) Patent No.: US 9,151,094 B2
(45) Date of Patent: Oct. 6, 2015

(54) DEVICE FOR CONNECTING DOOR AND WINDOW OPERATING UNITS

(75) Inventor: Marco Lambertini, San Lazzaro di Savena (IT)

(73) Assignee: GSG INTERNATIONAL S.P.A., Budrio (IT)

( * ) Notice: Subject to any disclaimer, the term of this patent is extended or adjusted under 35 U.S.C. 154(b) by 755 days.

(21) Appl. No.: 13/126,408

(22) PCT Filed: Dec. 5, 2008

(86) PCT No.: PCT/IB2008/003355

§ 371 (c)(1),
(2), (4) Date: Apr. 27, 2011

(87) PCT Pub. No.: WO2010/049750

PCT Pub. Date: May 6, 2010

(65) Prior Publication Data

US 2011/0204657 A1 Aug. 25, 2011

(30) Foreign Application Priority Data

Oct. 30, 2008 (IT) ..... BO2008A0663

(51) Int. Cl.
*E05C 9/16* (2006.01)
*E05C 9/02* (2006.01)
(Continued)

(52) U.S. Cl.
CPC .. *E05C 9/02* (2013.01); *E05C 9/185* (2013.01)

(58) Field of Classification Search
USPC ..... 292/DIG. 20, 3, 8, 9, 23, 32, 33, 35, 36, 292/40, 41, 137, 156, 158, 161, 163, 164, 292/166, 167, 168, 173, 174, 193, 340, 341, 292/341.15, 341.18, 341.19, DIG. 15, 292/DIG. 21, DIG. 23, DIG. 38, DIG. 46, 292/DIG. 47, DIG. 53, DIG. 54, 336.3, 292/DIG. 64; 49/394, 395, 192, 193, 449, 49/503, 506, 460
See application file for complete search history.

(56) References Cited

U.S. PATENT DOCUMENTS 3,368,306 A * 2/1968 Von Wedel ..... 49/192
3,994,093 A * 11/1976 Mayer et al. ..... 49/192
(Continued)

FOREIGN PATENT DOCUMENTS

DE 3307209 A1 * 9/1984
DE 3333702 A1 * 4/1985
(Continued)

OTHER PUBLICATIONS

Computer-generated translation for DE4016777 using EPO Patent Search website, http://ep.espacenet.com/.*
(Continued)

*Primary Examiner* — Alyson M Merlino
(74) *Attorney, Agent, or Firm* — Pearne & Gordon LLP

(57) ABSTRACT

A device for connecting operating units (8) for doors and windows comprising: a control element (4) mounted on the operating side (3 *a*) of a mobile frame (3); a rod segment (5) that is slidably mounted in a groove (C), made at least in the operating side (3*a*) and is connected to the control element (4) in such a way as to slide in both directions within the groove (C) to define the open and closed configurations of the door/window (1*a*, 1*b*); the rod segment (5) being associated by respective connecting means (10, 12), with elements (105, 6) that are functional or accessory to the operation of the rod segment (5), said elements (105, 6) protruding from the groove (C); these connecting means comprise at least one base (10) connected to at least one functional or accessory element (105, 6) defined by an operative portion (9); the size of the base (10) is such that, in use, it covers a free front section of the rod segment (5), the base (10) being frontally applicable to the rod segment (5) before the latter is inserted into the groove (C), and a bottom end extension (12) protruding transversally of the base (10), shaped to match the profile of the operating rod segment (5) and designed to be coupled to a respective slot (5*a*) formed on the rod (5) in such a way as to create a portion for uninterruptedly connecting and stiffening the rod segment (5) itself.

20 Claims, 8 Drawing Sheets

(51) Int. Cl.
*E05C 9/18* (2006.01)
*E05B 3/00* (2006.01)

(56) References Cited

U.S. PATENT DOCUMENTS

| | | | | | |
|---|---|---|---|---|---|
| 4,002,360 | A * | 1/1977 | Frank et al. | 292/336.3 |
| 4,208,838 | A * | 6/1980 | Kleine et al. | 49/192 |
| 4,420,905 | A * | 12/1983 | Kucharczyk | 49/192 |
| 4,624,075 | A * | 11/1986 | Vigreux | 49/192 |
| 6,641,182 | B2 * | 11/2003 | Schlack et al. | 292/36 |
| 7,004,515 | B2 * | 2/2006 | Timothy | 292/137 |
| 7,100,327 | B2 * | 9/2006 | Rangabasyam et al. | 49/395 |
| 7,219,469 | B2 * | 5/2007 | DiFrancesco | 49/395 |
| 7,581,768 | B2 * | 9/2009 | Balbo Di Vinadio | 292/288 |
| 7,708,322 | B2 * | 5/2010 | Timothy et al. | 292/137 |
| 7,913,456 | B2 * | 3/2011 | Balbo Di Vinadio | 49/506 |
| 2005/0144848 | A1 * | 7/2005 | Harger et al. | 49/449 |
| 2008/0016773 | A1 * | 1/2008 | Di Vinadio | 49/192 |
| 2008/0016782 | A1 * | 1/2008 | Balbo Di Vinadio | 49/506 |
| 2008/0150300 | A1 * | 6/2008 | Harger et al. | 292/32 |
| 2009/0025301 | A1 * | 1/2009 | Di Vinadio | 49/506 |

FOREIGN PATENT DOCUMENTS

| | | | |
|---|---|---|---|
| DE | 3335306 | A1 * | 4/1985 |
| DE | 4016777 | A1 * | 12/1991 |
| DE | 199 09 400 | A1 | 9/2000 |
| EP | 64595 | A1 * | 11/1982 |
| EP | 128429 | A2 * | 12/1984 |
| EP | 383003 | A2 * | 8/1990 |
| EP | 572988 | A1 * | 12/1993 |
| EP | 573819 | A2 * | 12/1993 |
| EP | 1 132 169 | A2 | 9/2001 |
| EP | 1 159 502 | B1 | 12/2001 |
| EP | 1 454 708 | A2 | 9/2004 |
| EP | 1 460 216 | A2 | 9/2004 |
| GB | 2215392 | A * | 9/1989 |
| IT | BO2007A000444 | A1 | 12/2008 |
| IT | BO2007A000445 | A1 | 12/2008 |
| JP | 02204588 | A * | 8/1990 |

OTHER PUBLICATIONS

Computer-generated translation for DE4016777 using EPO Patent Search website, http://ep.espacenet.com/, Translated Apr. 26, 2014.*

* cited by examiner

DEVICE FOR CONNECTING DOOR AND WINDOW OPERATING UNITS

TECHNICAL FIELD

This invention relates to a device for connecting operating units for doors and windows, in particular doors and windows made of metal, PVC, or PVC and wood.

This connecting device can be used on operating units applicable to doors and windows of different kinds, namely: traditional, tilt and turn, bottom-hung, top-hung or sliding doors and windows.

BACKGROUND ART

Generally speaking, doors and windows essentially comprise:

- a fixed frame;
- a mobile frame, or sash in the case of tilt and turn units, slidably connected or hinged to the fixed frame;
- a control handle mounted on one of the vertical members of the mobile frame;
- at least one rod segment slidably mounted in a groove made in the vertical member and connected to, and controlled by, the control handle (in some cases, where there is a traditional handle, the connection is obtained by drive elements constituting accessories of the rod) in such a way as to slide in both directions in the groove to define at least one open configuration and one closed configuration of the door or window;
- closing means associated with, and protruding from, the operating rod (to define additional accessories of the rod) and designed to oppose or engage respective fixed abutment means located on the vertical member of the fixed frame in order to define the closed configuration.

More specifically, the accessories may comprise, for the drive means, two facing protrusions or tabs or two bosses forming a space occupied by the handle lever to permit transmission of the motion produced by turning the handgrip of the handle and thus displacing the rod in the groove.

The closing means, on the other hand, may be embodied by pins or bosses and catches (in the case of sliding doors/windows) stably associated with the rod.

As is known, these drive and closing elements are applied to the operating rod by connecting means consisting of: a socket made in the central section of the rod (half way along the width of the rod) and a suitable bottom portion of these elements housed in the socket and locked in place preferably by plastic deformation of the material the bottom portion of the element is made of or by caulking.

Examples of these applications are disclosed in document EP 1.454.708 (in the name of the same Applicant as this invention) as regards an example of a drive boss, in documents EP 1.132.169 and EP 1.460.216 (also both in the name of the same Applicant as this invention) as regards the above mentioned pins or bosses, and in Italian patent applications BO2007A000444 and BO2007A000445 (also in the name of the same Applicant as this invention) as regards the closing catches for sliding doors and windows which, in one of these cases, is locked to the rod by means of the specially shaped bottom portion of an element or pin.

These connecting means, very practical for positioning the accessories and quick to apply, have been shown to have one drawback due to poor holding strength over time leading to deterioration of the rod-accessory assembly.

As regards the striker elements, the step of moving the rod to close the door or window, in the case of pins or bosses, comprises sliding the rod along the groove until the boss is laterally or tangentially coupled to a retaining wall of the above mentioned abutment element.

This coupling pushes the boss sideways and produces a force (moment) both on the boss and on the zone where the connecting means are coupled to the rod (usually made of a synthetic material such as polyamide) housed relatively loosely—precisely because it is slidable—in the operating groove: these forces, with repeated use over time, eventually deteriorate the coupling and weaken the join between the rod and the boss and, more seriously still, the area surrounding the rod.

This deterioration reduces the strength of the door or window and, in the more serious cases, causes the rod to break or the boss to be detached from the rod, with obvious problems in terms of door/window security.

Similarly, as regards the above mentioned catch, the coupling to the respective abutment element—first abutting the front inside a socket and then lifting or lowering inside the socket for locking in the closed configuration—produces upwardly or downwardly directed lateral strain, leading to front stresses on the point where the catch and the rod are joined and creating the same problems as those mentioned above for the boss.

As regards the drive elements, one or more protrusions or levers are pushed in onto the tab or boss, producing an upwardly or downwardly directed lateral force (moment) similar to the one mentioned above in connection with the catch, leading to front stresses on the point where the tab and the rod are joined and creating the same problems as those mentioned above for the closing bosses.

In addition to the above, account must also be taken of break-in attempts which not only produce further, contingent strain on the door or window but are also facilitated by existing wear, especially on the closing elements.

DISCLOSURE OF THE INVENTION

This invention therefore has for an aim to overcome the above mentioned disadvantages by providing a device for connecting operating units for doors and windows that is at once more compact and wear-resistant than prior art devices.

Another aim of the invention is to provide a connecting device for operating units which at least partly isolates the operating rod from the strain due to tension arising out of contact between the accessories and the respective thrust or abutment elements.

A further aim of the invention is to provide a connecting device for operating units whose structure does not alter the basic constructional architecture of the operating rods on which it is to be mounted.

In accordance with the invention, the above aims are achieved by a connecting device, in particular a device for connecting operating units for doors and windows, comprising the technical characteristics set out in one or more of the appended claims.

BRIEF DESCRIPTION OF THE DRAWINGS

The technical characteristics of the invention, with reference to the above aims, are clearly described in the appended claims and its advantages are apparent from the detailed description which follows, with reference to the accompanying drawings which illustrate a preferred embodiment of the invention provided merely by way of example without restricting the scope of the inventive concept, and in which:

DETAILED DESCRIPTION OF THE PREFERRED EMBODIMENTS OF THE INVENTION

Figure 1:
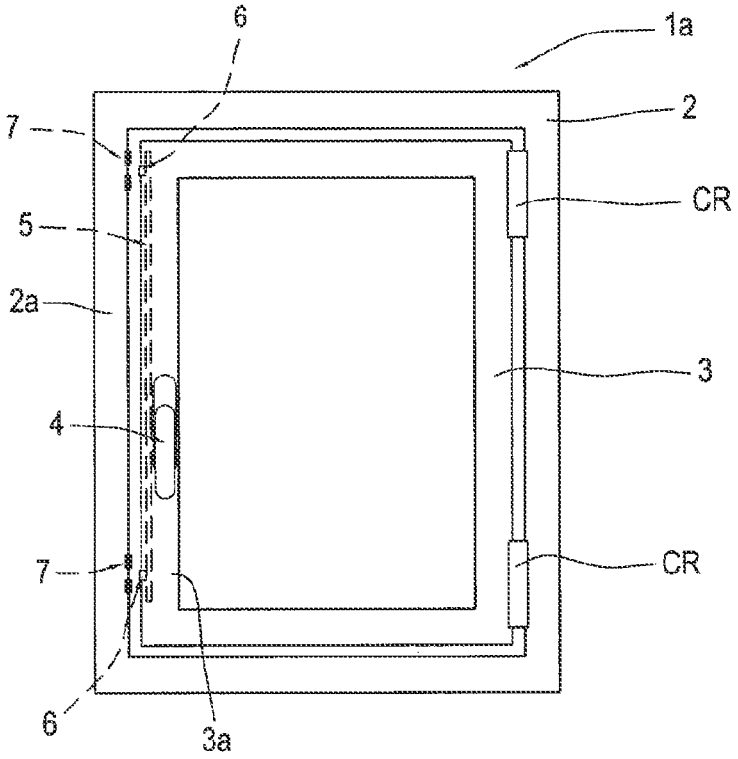
FIG. 1 is a schematic front view of a traditional window equipped with the operating unit connecting device according to this invention.
Figure 2:
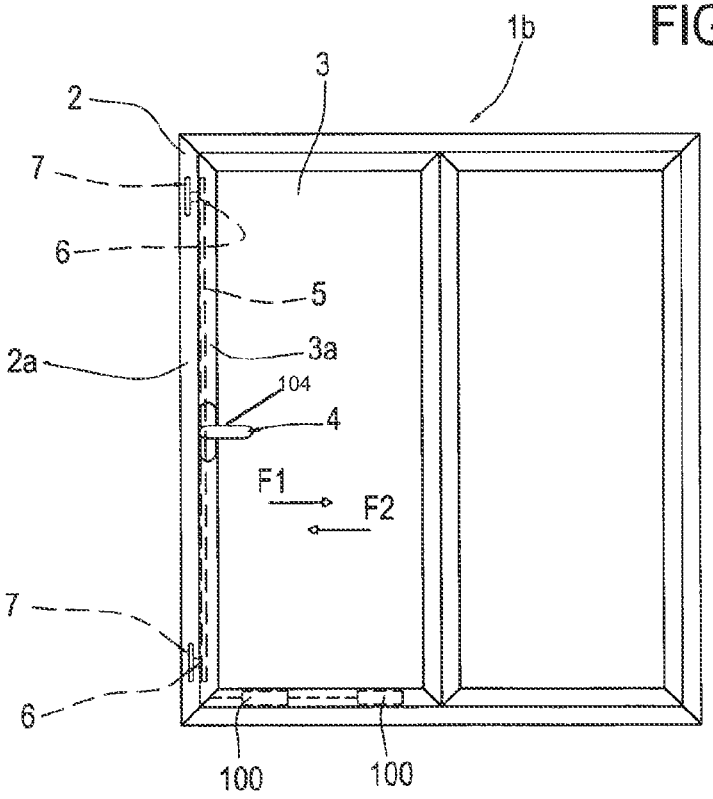
FIG. 2 is a schematic front view of a sliding window equipped with the operating unit connecting device according to the invention.

With reference to the accompanying drawings, in particular FIGS. 1 and 2, the connecting device according to the invention is used on an operating unit, labelled 8 in its entirety, applicable to doors and windows of different kinds such as for example, the traditional window labelled 1*a* in FIG. 1 and the sliding window labelled 1*b* in FIG. 2.

These doors or windows 1*a* and 1*b*, made of metal, PVC or aluminium and wood, basically comprise: a fixed frame 2; a mobile frame 3; a control element 4; at least one rod segment 5; and a set of elements 105, 6 that are functional or accessory to the operation of the rod segment 5, can be associated with the rod 5 through respective connecting means 10, 12 and enable the rod 5 to be moved or, as described in more detail below, to define the open or closed configuration of the door/window 1*a*, 1*b*.

We have used the term rod segment 5 because, depending on the type and size of the door/window 1*a*, 1*b*, the rod 5 may be a single part (as shown by way of non-limiting example in FIGS. 20 and 21) or it may be divided into two or more segments in a single groove C.

Figure 20:
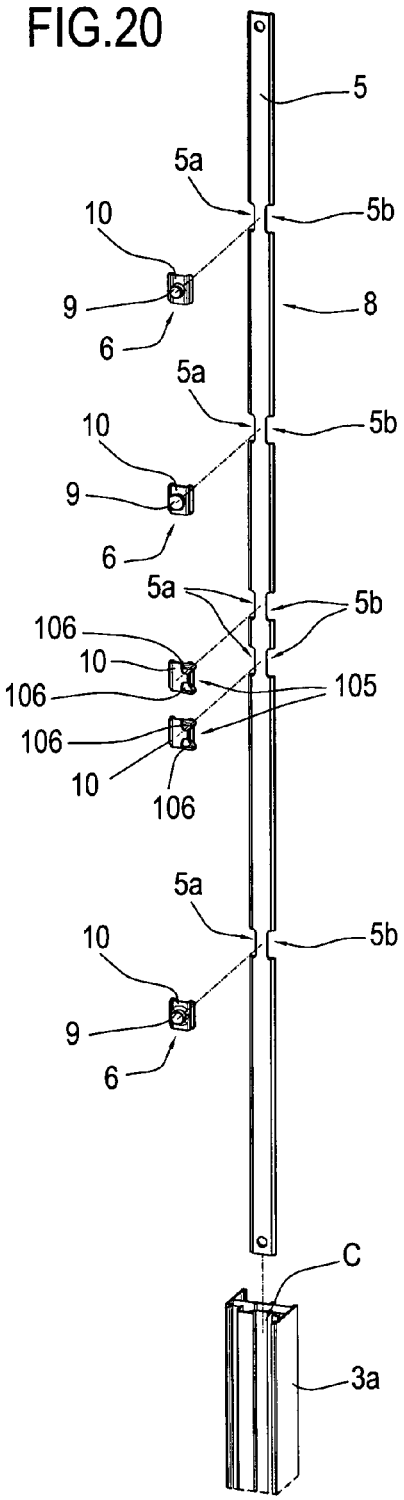
FIG. 20 illustrates accessories equipped with the device for connection to a rod and forming part of an operating unit applicable to one of the vertical members of a door or window, in an exploded perspective view prior to assembly to the operating unit.
Figure 21:
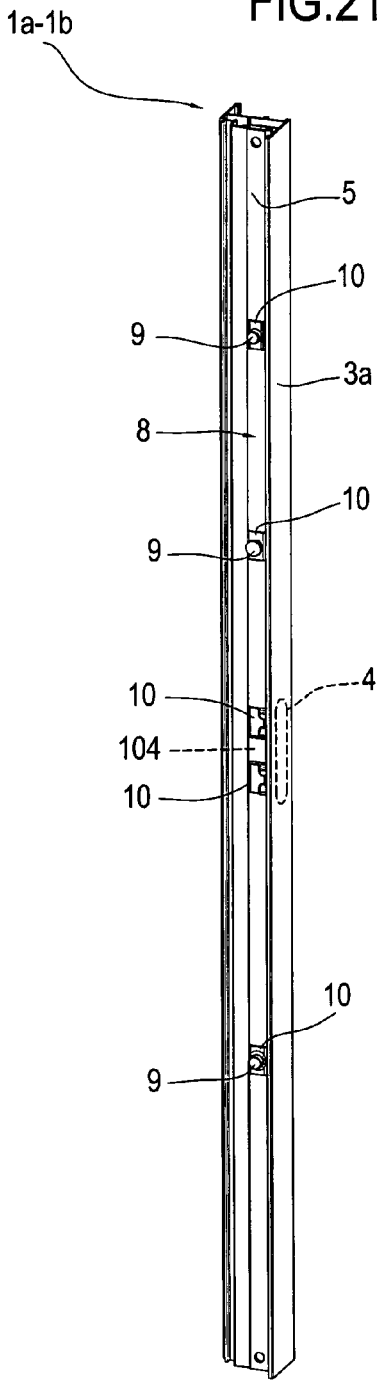
FIG. 21 illustrates the operating unit of FIG. 20 in a perspective view and in an assembled configuration.
Figure 22:
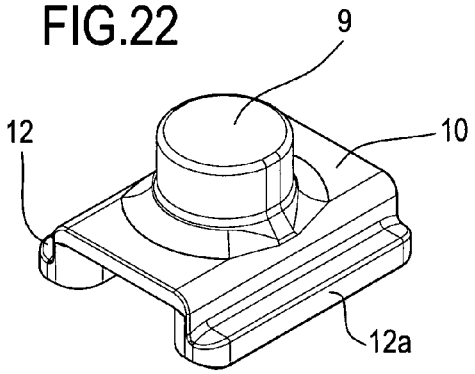
FIGS. 22 and 23 are, respectively, a perspective view and a front view of a drive or closing element equipped with the device for connection to the operating unit.
Figure 23:
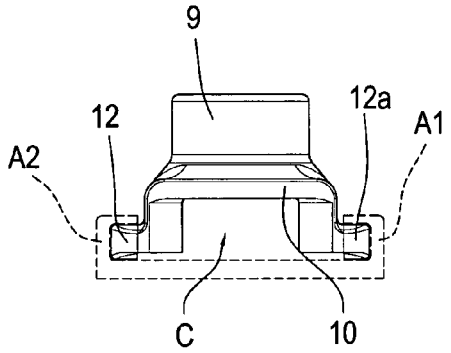
Figure 24:
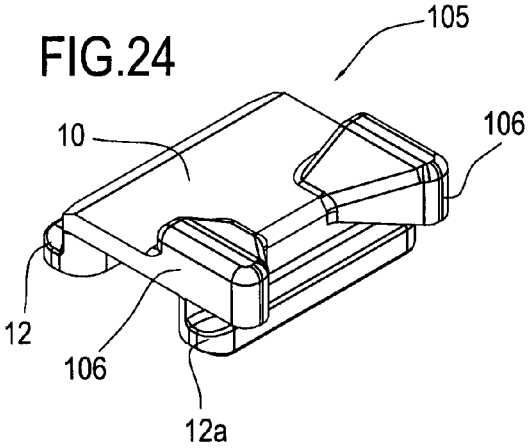
FIGS. 24 to 27 are, respectively, perspective, top plan, side and front views illustrating another embodiment of a drive or closing element equipped with the device for connection to the operating unit.
Figure 25:
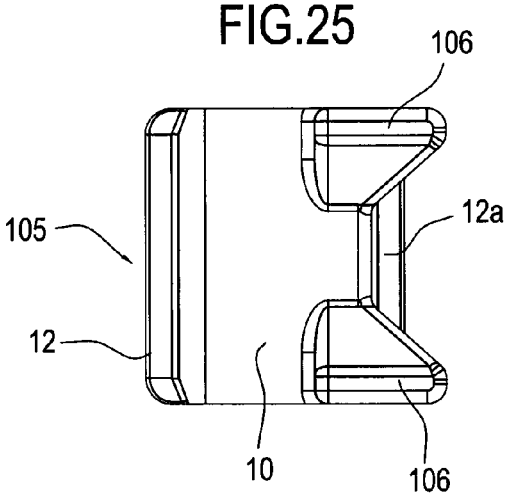
Figure 26:
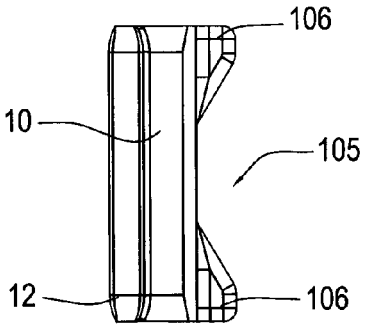
Figure 27:
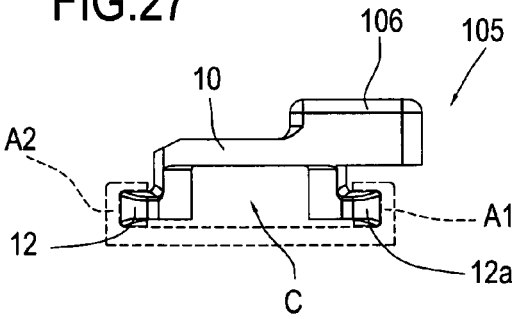

FIGS. 20 and 21 illustrate two examples of accessory elements, namely: drive elements 105 associated with the rod 5 for connecting the operating element 4, and closing elements 6 interacting with a respective abutment element 7.

More in detail, the mobile frame 3 is connected to the fixed frame 2 and able to move relative to the fixed frame 2 between at least one open configuration and a closed configuration.

Obviously, in the traditional door/window 1*a*, the mobile frame 3 is hinged (by hinges CR) to a vertical member of the fixed frame, while the sliding door/window 1*b* is slidably constrained between the two horizontal members of the fixed frame and moves (in the directions indicated by the arrows F1 and F2) on one or more carriages 100 interposed between the bottom horizontal members of the two frames 2 and 3.

The control element 4 is mounted on an operating side 3*a* of the mobile frame 3 and usually comprises a traditional handle with a lever 104, or it may comprise a recessed handle.

The rod segment 5 is positioned slidably in a groove C made at least in the operating side 3*a* and is connected to and controlled by the control handle 4 in such a way as to slide in both directions within the groove C to define the open and closed configurations of the door/window 1*a* and 1*b*.

As is known, the groove C is formed on the profile of the door/window 1*a* or 1*b* by two wings A1 and A2 transversal to the profile and two opposite sections C1 and C2 perpendicular to the wings A1 and A2 (see FIGS. 3, 5, 11, 15, 20 and 21).

Obviously, the rod segments 5 may also be located on the other sides of the door/window 1*a* or 1*b* without thereby limiting the scope of the invention.

As already mentioned, the drive elements 105 and the closing element 6 can be associated with the rod segment 5 and protrude from the groove C (see also FIGS. 3, 11 and 15, 20 and 21) so as to oppose or engage the lever 104 of the handle 4 (see broken line in FIG. 21) and the respective abutment element 7 located on a corresponding side 2*a* of the fixed frame 2 in order to define the above mentioned closed configuration.

The abutment element is illustrated schematically in FIGS. 1 and 2 since it is of well known type and does not fall within the scope of the invention.

Usually, there are two drive elements 105 located on both sides of the lever 104 so as to drive it in a straight line in directions F3 and F4, FIG. 21, enabling the rod 5 to slide and then define the open and closed configurations of the door/window 1*a* or 1*b*.

The drive elements 104 are not always necessary, for example when a recessed handle is used.

Obviously, the number of closing elements 6 and related abutment elements 7 on the rod 5 and on the fixed frame 2 may also vary according to the type of door/window 1*a* and 1*b* (without limiting the scope of the invention).

As may be observed in the examples shown in FIGS. 3 to 31, each drive element 104 and each closing element 6 (forming part, in this case, of the operating unit 8) is associated with the rod segment 5 through respective connecting means comprising at least: a base 10 and a bottom end extension 12.

The base 10 is or can be associated with the functional or accessory element 105, 6 which basically constitutes an operative portion 9 for abutting against or coupling to the lever 104 and/or the abutment element 7.

The operative portion 9, therefore, when used as a drive element 105, may be a customary pin or boss or, as shown in FIGS. 24 to 27, two appendages 106 projecting laterally from the base 10 and shaped in such a way as to form two opposing walls, one of which, in use, comes alternately into contact with the lever 104 on the handle 4 according to the sliding direction imparted to the rod segment 5.

Similarly, for each closing element 6, the operative portion 9 is substantially defined by a pin or boss (in the embodiments for traditional doors/windows 1*a* or tilt and turn doors/windows) or a catch in the embodiments for sliding doors/windows 1*b*.

The base 10 may be made as a single part or integral with the operative abutment or coupling portion 9, or it may be stably coupled (by deformation) to the operative portion 9.

Further, the size of the base 10 is such that, in use, it covers a free front section of the rod segment 5: in other terms, the base 10 is substantially quadrangular in shape to match a portion of the rod segment 5.

As shown in FIGS. 5, 13, 17, 20 and 21, the base 10, with the related operative portion 9, can be applied frontally to the rod 5 before the latter is inserted into the groove C.

In a hypothetical minimum configuration both for the drive elements 105 and for the closing elements 6, the base 10 may be provided with a single, bottom end extension 12 protruding transversally of the base 10, shaped to match the profile of the operating rod segment 5 and designed to be coupled to a respective slot 5*a* formed on the rod 5 in such a way as to create on it an uninterrupted connecting and stiffening portion.

Obviously, for correctly balancing the forces in play during use, each base 10 preferably has at least one pair of extensions 12, 12*a* extending from the bottom of the base 10 itself (this minimum configuration is illustrated clearly in the examples of FIGS. 22 to 31). These two extensions 12 and 12*a* can be coupled to a pair of opposite slots 5*a*, 5*b* formed on the rod 5.

This configuration is itself sufficient to provide the mechanical strength necessary to stabilize the zone where the base 10 is coupled to the rod 5, effectively isolating the top operative zone of the portion 9 from the action of the forces acting on the portion 9 itself and the respective coupling or abutment elements (lever 104 or abutment elements 7).

Figure 8:
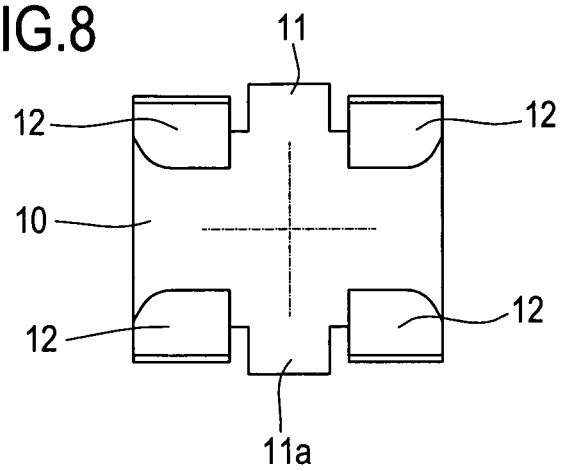
FIGS. 7 to 10 illustrate the element shown in the drawings listed above in a side view, a bottom plan view, a top plan view and in a section view through the line X-X of FIG. 9, respectively.
Figure 7:
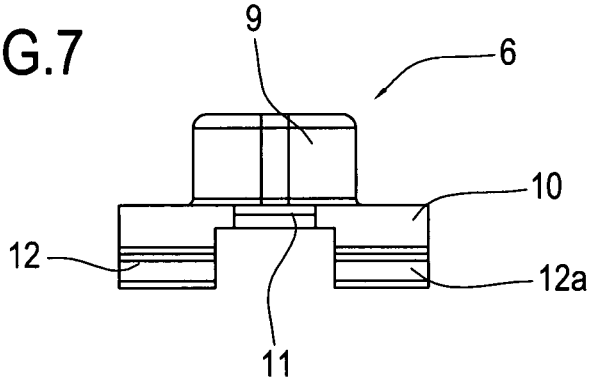
Figure 9:
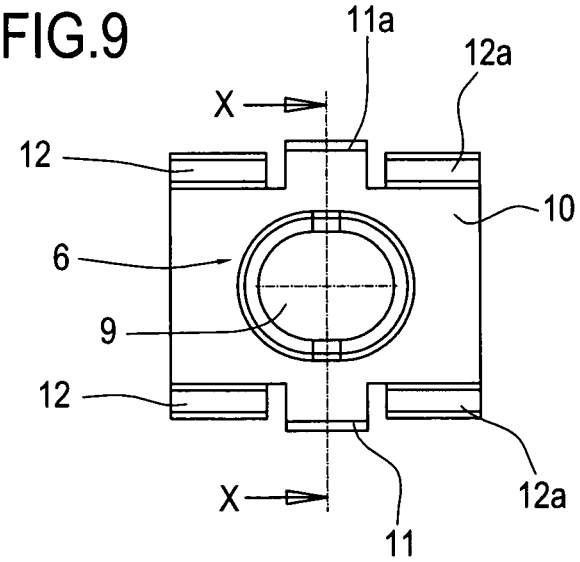
Figure 10:
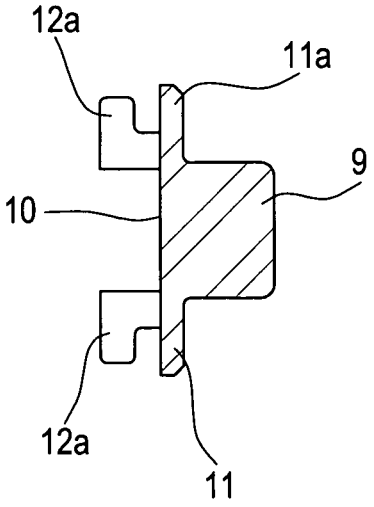
Figure 11:
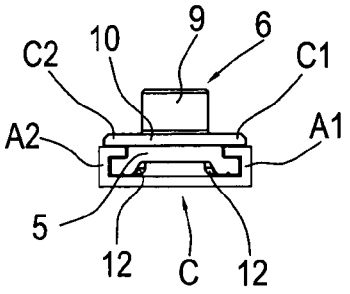
FIGS. 11 to 14 are, respectively, front, side, exploded perspective and assembled perspective views of a second embodiment of an operating or closing element equipped with the device for connection to the operating unit applied to a rod.
Figure 12:
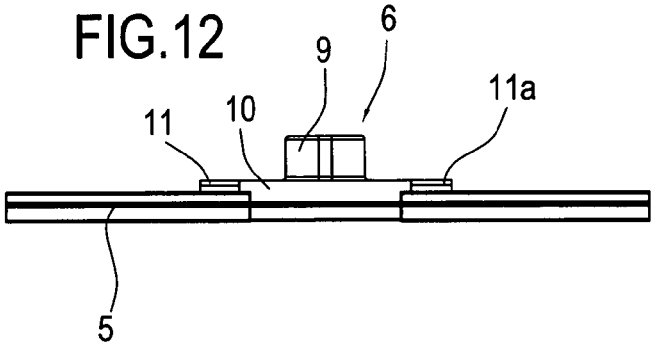
Figure 13:
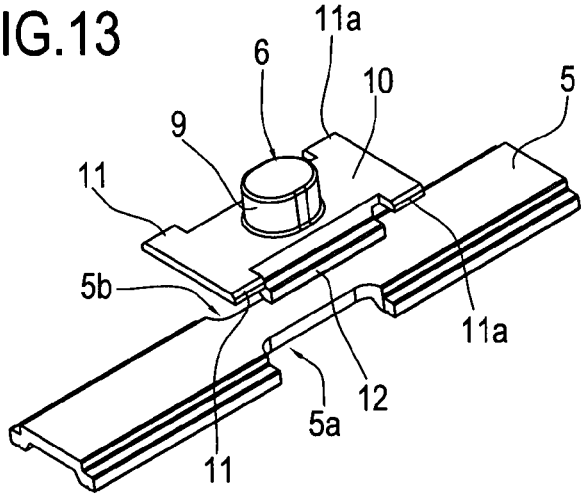
Figure 14:
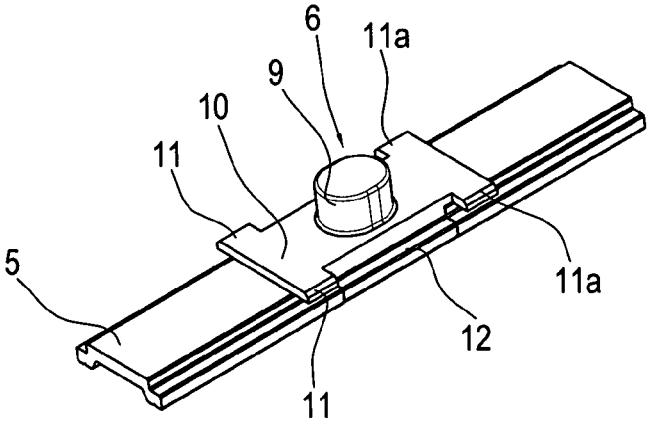
Figure 15:
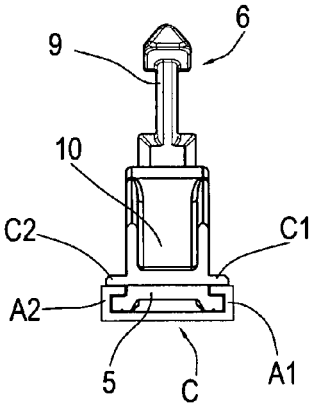
FIGS. 15 to 18 are, respectively, front, side, exploded perspective and assembled perspective views of a third embodiment of a closing element equipped with the device for connection to the operating unit applied to a rod.
Figure 16:
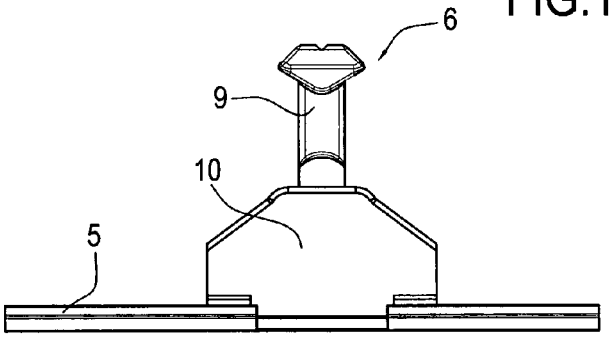
Figure 17:
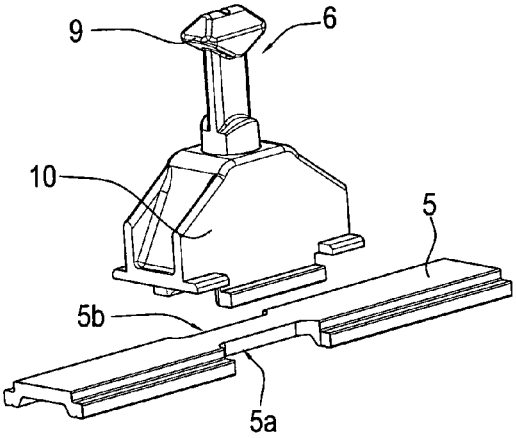
Figure 18:
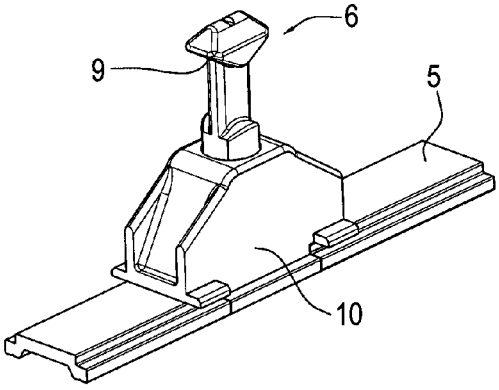

This fact can be confirmed by observing FIG. 8, which shows that the outer perimeter of each of the bottom end extensions 12, 12*a* is shaped to match the respective slot 5*a*, 5*b* formed on the rod 5: thus, the slots 5*a*, 5*b* are fully occupied by the bottom protrusions 12, 12*a* which effectively become part of the rod 5, completing it and preventing it from weakening.

Further, with this combination of base 10 and operative portion 9, the operative portion 9 itself can come in many different constructional forms.

In FIGS. 3 to 14, 19 and 22 and 23, the boss 9 is, so to speak, of a type with known shape, made as a single part with the base 10.

Figure 28:
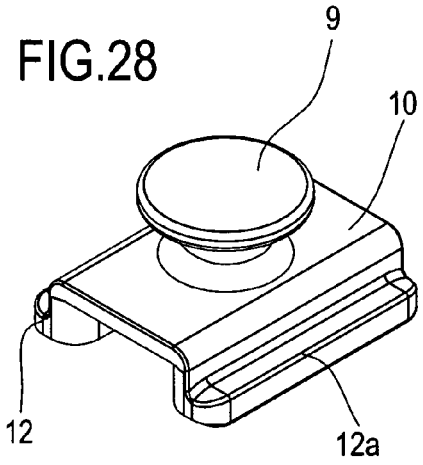
FIGS. 28 and 29 are, respectively, a perspective view and a front view of yet another embodiment of a closing element equipped with the device for connection to the operating unit.
Figure 29:
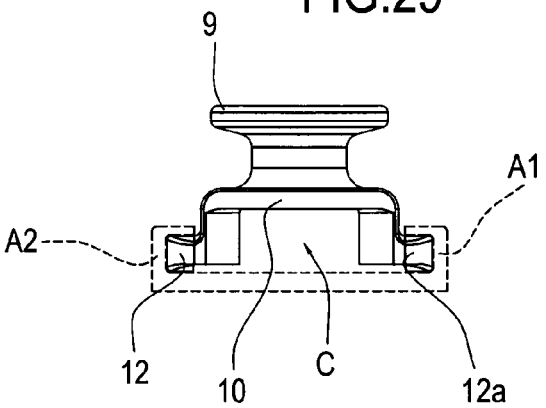

In FIGS. 28 and 29, the boss 9 is applied (riveted) to the base 10 and is mushroom shaped to provide good anti break-in properties (the base and the boss might be made of steel, for example).

Figure 30:
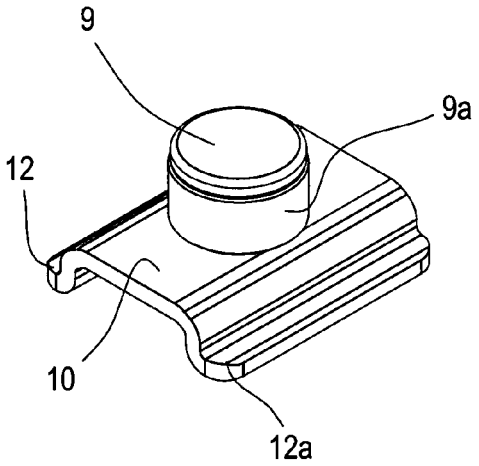
FIGS. 30 and 31 illustrate a yet further embodiment of a drive or closing element equipped with the device for connection to the operating unit, in perspective and front views, respectively.
Figure 31:
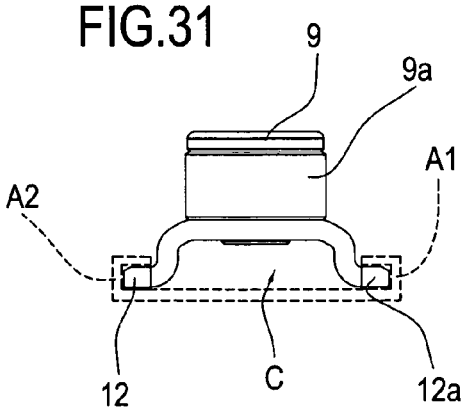

In FIGS. 30 and 31, the boss 9 is, again, applied to the base 10, but is divided into two parts, an inner pin for association with the base 10 and an outer cylindrical bush 9*a* with lower friction properties.

The validity and working versatility of the solution provided by the invention is also confirmed in FIGS. 3 to 9, showing that the base 10 may be equipped with a lateral tab 11 protruding from the base 10, in the same plane as the base 10 and designed, in use, to abut one of the two flat sections C1 or C2 forming part of the groove C.

Figure 3:
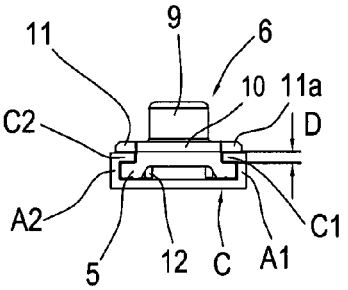
FIGS. 3 and 4 are, respectively, a front view and a side view illustrating a first embodiment of the connecting device according to the invention applied to a rod.
Figure 4:
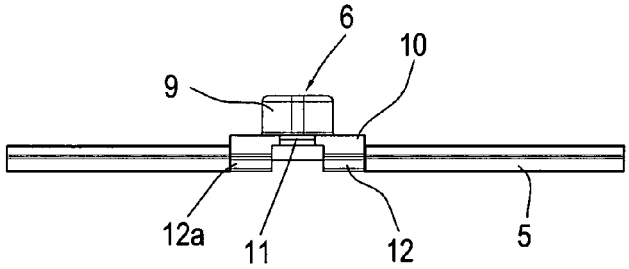
Figure 5:
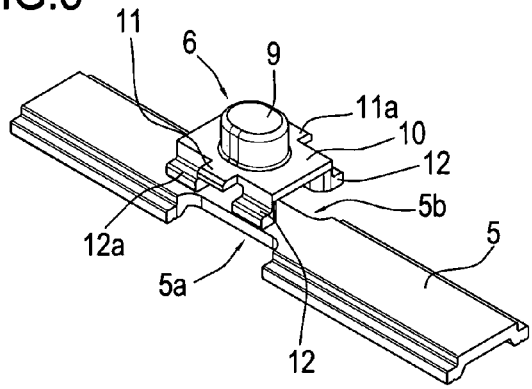
FIGS. 5 and 6 are, respectively, an exploded perspective view and a perspective view, showing the element of FIGS. 3 and 4.
Figure 5:
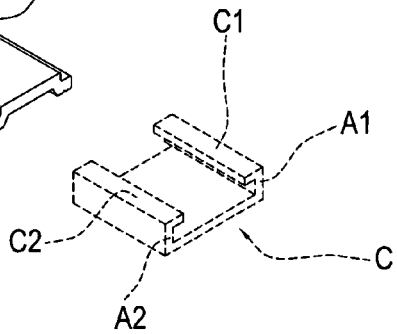
Figure 6:
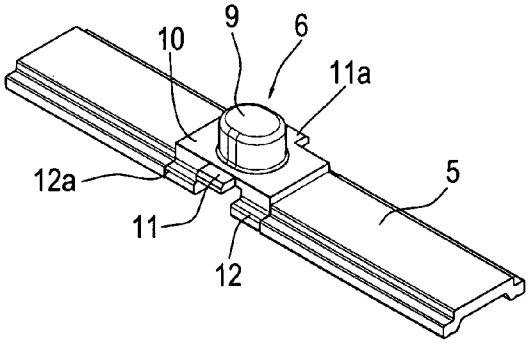

To enable the rod segment 5 to slide, the distance D between the bottom end extension 12 (substantially defining the end "foot") and the tab 11 is at least equal to the thickness of a respective flat section C1, C2 (see FIG. 3).

Starting from this further configuration, there may be numerous constructional combinations between the tab 11 and the extensions 12, depending also on constructional requirements and rod segment 5 design.

In the example illustrated in FIGS. 3 to 9, the base 10 has at least two opposite tabs 11, 11*a* protruding from both sides of the base 10 in such a way as to abut, when in use, the respective flat sections C1, C2 forming a part of the groove C.

In this case, the two tabs 11, 11*a*, protrude from both sides of the central portion of the base 10.

In this embodiment, the base 10 has two pairs of bottom end extensions 12, 12*a* protruding from the respective ends of the base 10 and designed to be coupled to respective opposite slots 5*a*, 5*b* in the rod 5.

In FIGS. 11 to 18, on the other hand, the base 10 has only two bottom end extensions 12, 12*a* located on both sides of the base 10 and designed to be coupled to respective opposite slots 5*a*, 5*b* in the rod segment 5.

In this configuration, the two extensions 12, 12*a* at the bottom of the base 10 protrude bilaterally from the central portion of the base 10 and are longer than in the embodiment described previously.

The base 10, with the central protrusions 12, 12*a*, is equipped with two pairs of tabs 11, 11*a* protruding from the respective ends of the base 10 in such a way that, in use, it rests on two or more zones of the respective flat sections C1 and C2.

In this specific embodiment, therefore, the base may have a perimetric profile in the shape of two opposing Tees.

These different configurations depend also on rod 5 machining requirements since the rods 5 are made, for example, by blanking to make the slots 5*a* and 5*b* which are open on the respective outer lateral surfaces.

With reference to FIGS. 3, 10, 11 and 15, it may be observed that, in cross section, the profile of each bottom end extension 12, 12*a* is the same as the profile of the rod 5 so that, in use, it connects smoothly with the profile of the rod 5 itself.

Figure 19:
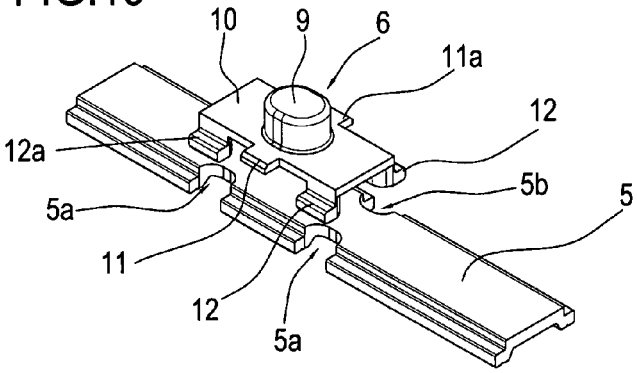
FIG. 19 is an exploded perspective view showing another embodiment of an element equipped with the device for connection to the operating unit of FIGS. 3 to 6.

FIG. 19 illustrates a solution of the closing element 6 where the base 10 has two pairs of bottom end extensions 12, 12*a* and where, for specific requirements of the door/window, the base 10 may be very long, so that the protrusions on it may be spaced very far apart: in this case, the bilateral pairs of slots 5*a*, 5*b* may be obtained separately to avoid weakening the rod 5 at that point.

With this type of operating unit, therefore, the functions of the entire operating and closing unit remain the same, while the production of the latter comprises making the slots in the rod—for example with suitable punches in customary machines for shaping the rods to size, which might be programmed to obtain different forms of connection between the accessory elements and the rod segment: in other words, the rod might have traditional housings for some of the accessory elements and the above mentioned slots for other accessory elements to be fitted.

The invention is so flexible that, for example, it allows a drive of traditional type to be combined with closing elements according to the invention, or vice versa.

Or else, the closing elements along the rod might be connected with traditional means whilst others, in more critical positions, might be of the type that use the connecting means according to this invention.

All this might be implemented very easily by suitably programming the rod shaping machines.

As regards assembly of the rod and the drive or closing elements using the connecting means just described, this can be done by placing each element frontally on the shaped rod segment and then sliding them into the groove in the door/window frame (as clearly shown in FIG. 20).

A connecting device made in this way thus achieves the above mentioned aims thanks to the presence of a base for stiffening the accessory element in the operating zone of the drive or closing element.

The wide base and the use of bottom end protrusions avoid discharging the forces acting on the drive element and on the boss or catch when the door/window is moved and closed.

Also, connecting the rod to a base with protrusions means that the rod segment only has a sliding/moving function while the mechanical pulling and bending forces are discharged onto the base and protrusion assembly and on the wings of the groove profile (in which the rod slides) thanks to the special shape of the protrusions.

By adding the above mentioned upper appendages, for example in the closing elements, it is possible to obtain a "clamp-like" hold on the groove in the abutment and coupling area to increase the mechanical retaining properties of the base.

These structures avoid subjecting the bottom of the drives or closing elements to continuous torque and thus increase their strength and improve their reliability and durability.

These advantages are obtained without significantly altering the constructional architecture of the remaining parts of the door/window. In fact, not only does the invention maintain the extremely reliable and time-tested configurations but also makes it possible to increase the possible working configurations of the operating units according to the end requirements of the door/window.

The invention described above is susceptible of industrial application and may be modified and adapted in several ways without thereby departing from the scope of the inventive concept. Moreover, all the details of the invention may be substituted by technically equivalent elements.

The invention claimed is:

1. A door/window connecting system comprising:

a fixed frame;

a mobile frame connected to the fixed frame and movable relative to the fixed frame between an open configuration and a closed configuration;

a control element mounted on an operating side of the mobile frame;

a rod segment having a front, a back, and first and second sides, the rod segment being slidably mounted in a groove made in the operating side, and being connected to the control element in such a way as to slide in two directions within the groove to define latched and unlatched states of the mobile frame relative to the fixed frame; the rod segment being connected by respective connecting means to a respective element that is functional or accessory to an operation of the rod segment, said element protruding from the groove, wherein the connecting means comprise:

a base connected to the respective element defining an operative portion; the size of the base being such that it covers a free section of the front of the rod segment, the base being applicable to the rod segment before the rod segment is inserted into the groove and;

one or more bottom end extensions protruding transversally of the base, each of the one or more bottom end extensions being shaped to match the profile of the rod segment and designed to be coupled to a respective slot formed in a lateral portion of the rod segment such that said respective slot opens to a corresponding one of the first and second sides so as to create a portion for uninterrupted stiffening of the rod segment, each of the one or more bottom end extensions being located in its respective slot such that the connecting means is longitudinally fixed to the rod segment by the cooperation between each of the one or more bottom end extensions and its respective slot alone so that when the rod segment slidably moves in the groove, the connecting means moves with the rod segment.

2. The door/window connecting system according to claim 1, wherein the base and the operative portion are made as a single part.

3. The door/window connecting system according to claim 1, wherein the base and the operative portion are stably coupled to each other.

4. The door/window connecting system according to claim 1, wherein the functional or accessory element is embodied by a closing element that can be associated with the rod segment, protruding from the groove and designed to oppose or engage a respective fixed abutment element located on a corresponding side of the fixed frame in order to define the closed configuration.

5. The door/window connecting system according to claim 1, wherein the functional or accessory element is embodied by a drive element that can be associated with the rod segment and designed to connect the rod segment to the control element in such a way as to be controlled by the control element.

6. The door/window connecting system according to claim 1, wherein the groove is defined, on a profile of the door/window, by two wings transversal of the profile and two flat sections perpendicular to the wings, wherein the base further comprises at least one lateral tab protruding from the base, co-planar with the base and designed to abut at least one of the two flat sections forming a part of the groove.

7. The door/window connecting system according to claim 6, wherein the at least one lateral tab includes two lateral tabs protruding from either side of the base in such a way as to abut the flat sections forming a part of the groove.

8. The door/window connecting system according to claim 1, wherein said one or more bottom end extensions comprises two bottom end extensions located on either side of the base, each of said two bottom end extensions being located in its respective slot, the two slots being located opposite each other in the rod segment.

9. The door/window connecting system according to claim 7, wherein the two lateral tabs protrude from either side of a central portion of the base.

10. The door/window connecting system according to claim 8, wherein the two bottom end extensions protrude from either side of a central portion of the base.

11. The door/window connecting system according to claim 6, wherein the at least one lateral tab includes two pairs of tabs protruding from respective ends of the base in such a way as to abut the flat sections forming a part of the groove.

12. The door/window connecting system according to claim 1, wherein said one or more bottom end extensions comprises two pairs of bottom end extensions protruding from respective ends of the base coupled with two pairs of respective slots being located in the rod segment.

13. The door/window connecting system according to claim 1, wherein, in cross section, the profile of each of the one or more bottom end extensions is the same as the profile of the rod segment so that the connecting means connects smoothly with the profile of the rod segment.

14. The door/window connecting system according to claim 1, wherein an outer or base perimeter of each of the one or more bottom end extensions is shaped to match its respective slot formed in the rod segment.

15. The door/window connecting system according to claim 1, wherein each respective slot formed in the rod segment is open on a respective outer lateral surface.

16. The door/window connecting system according to claim 1, wherein the distance between a bottom end of each of the one or more bottom end extensions and a corresponding tab is at least equal to the thickness of a respective flat section forming a part of the groove.

17. The door/window connecting system according to claim 4, wherein the operative portion of the closing element is embodied by a pin or boss.

18. The door/window connecting system according to claim 5, wherein the operative portion of the drive element is embodied by a pin or boss.

19. The door/window connecting system according to claim 5, wherein the operative portion of the drive element is embodied by two appendages projecting laterally from the base and shaped in such a way as to form two opposing walls, one of which comes into contact with a lever of the control element.

20. The door/window connecting system according to claim 17, wherein the pin or boss is mushroom shaped.

* * * * *